US006062720A

United States Patent [19]

Ionadi

[11] Patent Number: 6,062,720

[45] Date of Patent: May 16, 2000

[54] SCREW FEEDER DOSAGE UNIT PROVIDED WITH STIRRING DEVICE

[75] Inventor: Francesco Ionadi, Calvignasco, Italy

[73] Assignee: Andantex S.p.A., Milan, Italy

[21] Appl. No.: 09/096,619

[22] Filed: Jun. 12, 1998

[51] Int. Cl.[7] ..... B01F 11/00

[52] U.S. Cl. ..... 366/117; 222/185.1; 222/234; 222/413; 366/154.2

[58] Field of Search ..... 366/117, 118, 366/128, 186, 194–196, 607, 325.2, 331, 325.1, 342, 343, 154.1, 154.2; 222/185.1, 413, 233, 234

[56] References Cited

U.S. PATENT DOCUMENTS 2,209,143 1/1940 Tolman .
2,685,986 8/1954 Hampton .
4,195,753 4/1980 Dyer .
4,611,921 9/1986 Patel .

*Primary Examiner*—Matthew O. Savage
*Assistant Examiner*—Als Schwartz
*Attorney, Agent, or Firm*—R. Neil Sudol; Henry D. Coleman

[57] ABSTRACT

Screw-feeder dosage unit particularly for the dosage of solid or powdered products, which includes a frame which supports a hopper in which the product to be dosed is introduced, and an extractor for the product which is driven by a gearmotor. The unit includes a stirrer which is suspended inside the hopper, above the extractor, and is driven by an actuation means, the stirrer producing vibrations which allow separation of the product from the walls of the hopper for the descent of the product toward the extractor.

8 Claims, 3 Drawing Sheets

SCREW FEEDER DOSAGE UNIT PROVIDED WITH STIRRING DEVICE

BACKGROUND OF THE INVENTION

1. Field of the Invention

The present invention relates to a dosage unit of the screw-feeder type provided with a device for stirring the product contained in the hopper of the dosage unit.

2. Description of the Prior Art

The field of product dosage systems is well-acquainted with dosage units of the screw-feeder type provided with a hopper, into which the product to be dosed is introduced, and with a helical extractor for the product, which is is driven by a suitable gearmotor located in the lower portion of the hopper.

The hopper is generally shaped as a cone with the apex directed downward and the helical extractor is arranged at the apex.

A drawback of a dosage unit of the above described type is the fact that the product fed into the hopper for subsequent dosage tends to cling to the inclined walls of the hopper and its descent toward the helical extractor is not uniform.

Various embodiments have been proposed in order to obviate the above drawback, but they do not fully solve the problem.

A first embodiment of a conventional unit entails, for example, inducing vibrations in the walls of the hopper, so as to facilitate separation of the product from the walls. However, this embodiment has the drawback that the vibrations can compress the product and this hinders its descent toward the helical extractor.

A second embodiment of a conventional unit uses a hopper with rubber walls or a mixer inside the hopper.

The drawback of this second embodiment is that the mixer can break the product, if the product is fragile, and the rubber walls are subject to contamination.

Furthermore, the above described technical refinements have the additional drawback that they do not allow constant pressure on the helical extractor and therefore do not allow dosage of constant amounts of product.

An aim of the present invention is therefore to provide a dosage unit of the screw-feeder type which has a device for stirring the product fed into the hopper of the dosage unit which allows to maintain constant pressure of the product on the dosage unit.

An object of the present invention is to provide a screw-feeder dosage unit which has a device for stirring the product fed into the hopper of the dosage unit which allows to avoid damage to the product.

A further object of the present invention is to provide a screw-feeder dosage unit in which the stirrer never makes contact with the walls of the hopper of the dosage unit.

A further object of the present invention is to provide a screw-feeder dosage unit with a stirrer which can be removed from the hopper without introducing tools in the hopper.

A further object of the present invention is to provide a screw-feeder dosage unit, with stirrer, which is highly reliable, relatively easy to produce and at competitive costs.

SUMMARY OF THE INVENTION

The above aim, these objects and others which will become apparent hereinafter are achieved by a screw-feeder dosage unit particularly for the dosage of solid or powdered products, which includes a frame which supports a hopper in which the product to be dosed is introduced, and an extractor for the product which is driven by a gearmotor, characterized in that it furthermore comprises a stirrer which is suspended inside the hopper, above the extractor, and is driven by an actuation means, the stirrer producing vibrations which allow separation of the product from the walls of the hopper for the descent of the product toward the extractor.

BRIEF DESCRIPTION OF THE DRAWINGS

Further characteristics and advantages of the invention will become apparent from the description of a preferred but not exclusive embodiment of the screw-feeder dosage unit according to the invention, illustrated only by way of nonlimitative example in the accompanying drawings, wherein.

DESCRIPTION OF THE PREFERRED EMBODIMENTS OF THE INVENTION

Figure 1:
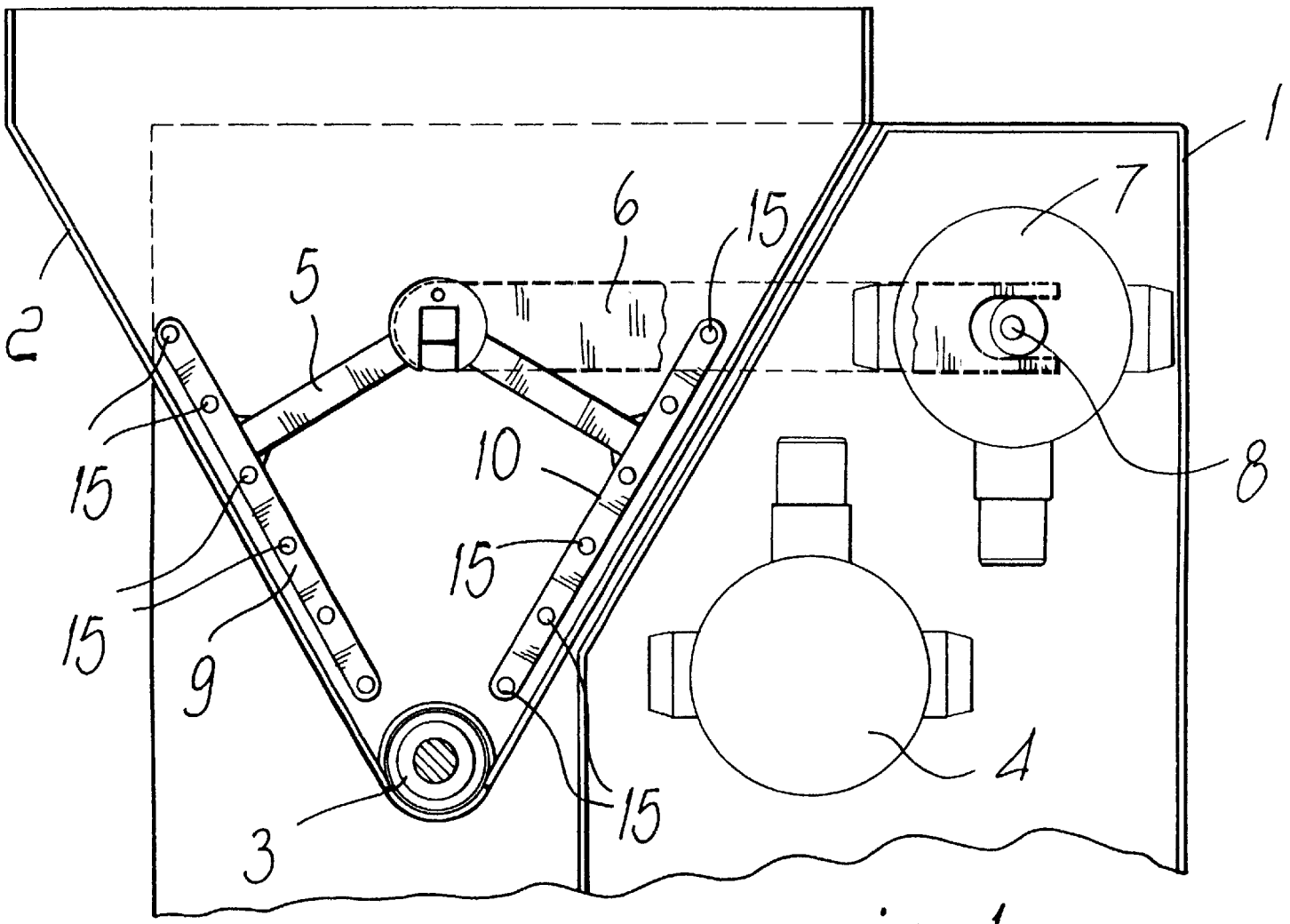
FIG. 1 is a front elevation view of the dosage unit according to the present invention.
Figure 2:
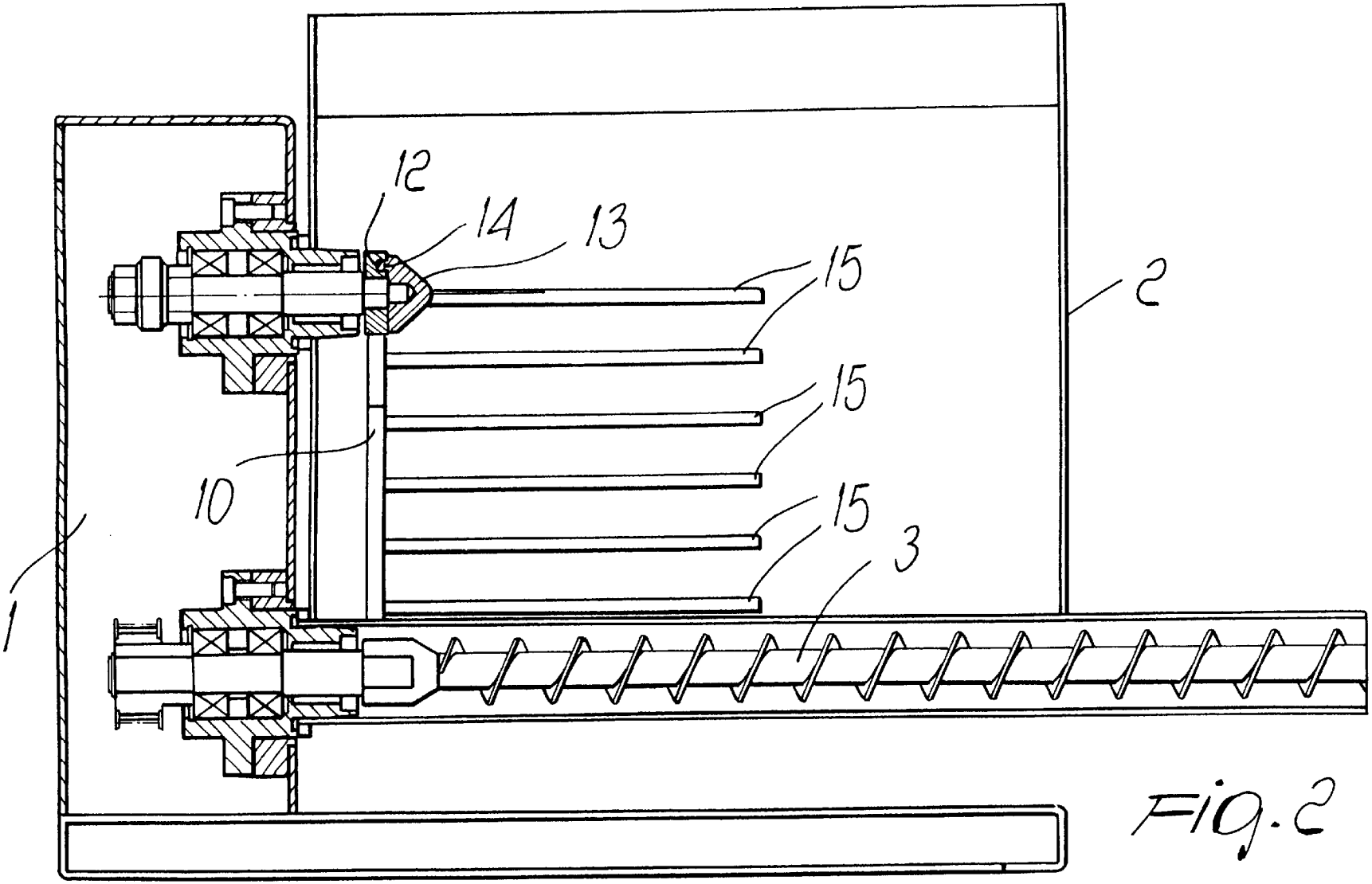
FIG. 2 is a sectional side view of the dosage unit shown in FIG. 1.
Figure 3:
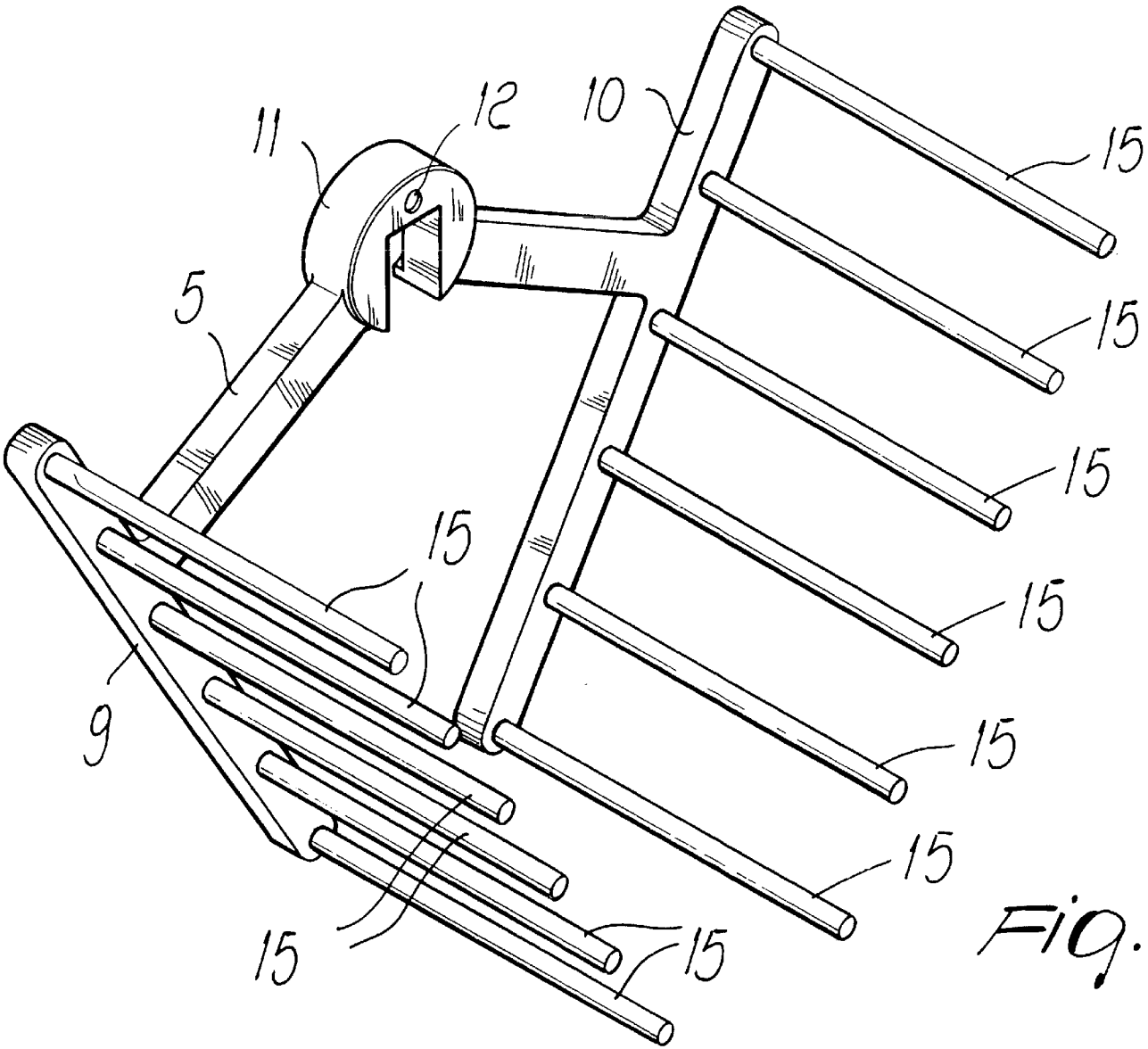
FIG. 3 is a perspective view of the stirrer provided inside the dosage unit according to the present invention.

With reference to the above figures, the dosage unit according to the invention includes a frame 1 which is suitable to support a hopper 2 which generally has a conical cross-section and in which the product to be dosed is introduced.

The term "product" designates any solid or powdered material introduced in the hopper 2.

At the lower region of the hopper 2, that is to say, proximate to the apex of the conical hopper, there is a per se known helical extractor (screw feeder) 3 which is driven by a suitable gearmotor 4.

A stirrer 5 is suspended inside the hopper 2 and is supported by a transmission arm 6 which is in turn connected to a gearmotor 7 by virtue of an eccentric means 8.

The stirrer 5 is constituted by a tubular structure which is complementary to the inside walls of the hopper 2 so that two arms 9 and 10 of the stirrer are adjacent to the inside walls without however making contact with them, even during the movement of the stirrer 5, as will become apparent hereinafter.

The arms 9 and 10 are connected, by beams, to a coupling member 11 which has a slot for coupling to an end of the transmission arm 6 which is located opposite the end of the arm that is engaged with the eccentric means 8.

The coupling member 11 has a through cavity 12 adapted to accommodate a pin 14 which protrudes from a locking means which is advantageously constituted by a safety locking dowel 13.

The safety locking dowel 13 prevents the disengagement of the transmission arm 6 from the slot formed in the coupling member 11.

Each one of the arms 9 and 10 of the stirrer is provided with a plurality of rod members 15 which are mutually parallel and are perpendicular to the plane that contains the tubular structure 5.

The rod members 15 are therefore parallel to the helical extractor 3.

With reference to the above figures, the operation of the dosage unit according to the invention is as follows.

The product to be dosed is introduced in a normal manner in the hopper 2 and the gearmotor 4 actuates the extractor 3 to perform dosage of the product introduced in the hopper 2.

The stirrer 5, actuated by the gearmotor 7 by virtue of the transmission arm 6 and the eccentric means 8, performs a vibrating oscillating motion without making contact with the walls of the hopper 2, thus applying a mixing vibration to the product contained in the hopper.

The vibration applied to the product causes the product to separate from the walls of the hopper 2 without interfering with the normal descent of the product toward the bottom of the hopper 2.

This oscillating-vibrating motion is ensured by the eccentric means 8.

In practice, it has been found that the screw-feeder dosage unit according to the invention fully achieves the intended aim, since it allows, by virtue of vibrations produced by the oscillation of the stirrer, to separate the product from the hopper walls without damaging the product, at the same time maintaining a constant pressure on the helical extractor, that is to say, keeping a same amount of product in contact with the extractor.

Furthermore, in the dosage unit according to the invention, the vibrating part (stirrer) is suspended inside the hopper without making contact with the walls thereof and can be disassembled without introducing tools in the hopper, with the consequent advantage of not contaminating the internal volume meant to contain the product to be dosed.

Once the stirrer has been removed, the hopper can be removed from the supporting frame to clean it accurately when the product to be dosed must be changed.

The device thus conceived is susceptible of numerous modifications and variations, all of which are within the scope of the same inventive concept; all the details may furthermore be replaced with other technically equivalent ones.

In practice, the materials uses, so long as they are compatible with the specific use, as well as the dimensions, may be any according to the requirements and the state of the art.

What is claimed is:

1. A screw-type dosage unit for producing doses of solid or powdered products, comprising: a frame; a hopper supported on said frame for receiving product to be dosed, said hopper including a first wall and a second wall; an extractor for removing controlled amounts of said product from said hopper; and a stirrer suspended inside said hopper above said extractor for generating vibrations to induce separation, from said first wall and said second wall, of product adhering to said first wall and said second wall, thereby permitting descent of product toward said extractor, said stirrer including a plurality of mutually parallel first rod members each on a different longitudinal axis, all located parallel to and adjacent to said first wall, said stirrer further including a plurality of mutually parallel second rod members each on a different longitudinal axis, all located parallel to and adjacent to said second wall; wherein said stirrer includes a symmetrical tubular structure which is complementary to an internal shape of said hopper, said rod members being mounted to said tubular structure; wherein said first rod members are mounted to a first arm of said tubular structure; said second rod members are mounted to a second arm of said tubular structure; said first rod members and said second rod members all extend parallel to a longitudinal axis of said extractor; and said stirrer is suspended in said hopper so that said first arm and said second arm are parallel to said first wall and said second wall, respectively.

2. The dosage unit according to claim 1, wherein said stirrer is actuated by a gearmotor which is arranged outside the hopper.

3. The dosage unit according to claim 2, wherein said stirrer is connected to a transmission arm, which is in turn connected to said gearmotor by an eccentric means.

4. The dosage unit according to claim 1, wherein said tubular structure is disposed in a plane, said first rod members and said second rod members being arranged symmetrically and at right angles to said plane.

5. The dosage unit according to claim 4, wherein said first rod members are mounted to said first arm of said tubular structure and said second rod members are mounted to said second arm of said tubular structure, said first arm and said second arm extending parallel to said first wall and said second wall, respectively, said first rod members and said second rod members all extending parallel to said extractor, said first arm and said second arm being connected to one another by two beams meeting centrally in a coupling member.

6. The dosage unit according to claim 4, wherein:

said stirrer is actuated by a gearmotor located outside said hopper;

said stirrer is connected to a transmission arm in turn connected to said gearmotor by an eccentric mechanism;

said first rod members are mounted to said first arm of said tubular structure;

said second rod members are mounted to said second arm of said tubular structure;

said first arm and said second arm extend parallel to said first wall and said second wall, respectively;

said first rod members and said second rod members all extend parallel to said extractor;

said first arm and said second arm are connected to one another by two beams meeting centrally in a coupling member; and said coupling member is provided with a slot for engaging an end of said transmission arm opposite said eccentric mechanism.

7. The dosage unit according to claim 4, wherein:

said stirrer is actuated by a gearmotor located outside said hopper;

said stirrer is connected to a transmission arm in turn connected to said gearmotor by an eccentric mechanism;

said first rod members are mounted to said first arm of said tubular structure;

said second rod members are mounted to said second arm of said tubular structure;

said first arm and said second arm extend parallel to said first wall and said second wall, respectively;

said first rod members and said second rod members all extend parallel to said extractor;

said first arm and said second arm are connected to one another by two beams meeting centrally in a coupling member;

said coupling member is provided with a slot for engaging an end of said transmission arm opposite said eccentric mechanism; and a safety locking mechanism is provided to prevent a disengagement of said transmission arm from said slot in said coupling member.

8. The dosage unit according to claim 4, wherein:

said stirrer is actuated by a gearmotor located outside said hopper;

said stirrer is connected to a transmission arm in turn connected to said gearmotor by an eccentric mechanism;

said first rod members are mounted to said first arm of said tubular structure;

said second rod members are mounted to said second arm of said tubular structure;

said first arm and said second arm extend parallel to said first wall and said second wall, respectively;

said first rod members and said second rod members all extend parallel to said extractor;

said first arm and said second arm are connected to one another by two beams meeting centrally in a coupling member;

said coupling member is provided with a slot for engaging an end of said transmission arm opposite said eccentric mechanism;

a safety locking mechanism is provided to prevent a disengagement of said transmission arm from said slot in said coupling member; and said safety locking mechanism comprises a dowel which has a pin engaging in a through cavity formed in said coupling member.

* * * * *